United States Patent [19]

Vermeulen et al.

[11] 4,333,815

[45] Jun. 8, 1982

[54] COAL LIQUEFACTION IN AN INORGANIC-ORGANIC MEDIUM

[75] Inventors: Theodore Vermeulen, Berkeley; Edward A. Grens, II, Danville; Ronald R. Holten, El Cerrito, all of Calif.

[73] Assignee: The United States of America as represented by the United States Department of Energy, Washington, D.C.

[21] Appl. No.: 17,299

[22] Filed: Mar. 5, 1979

[51] Int. Cl.[3] ..... C10G 1/06; C10G 1/08

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 2,223,184 | 11/1940 | Pier | 208/8 LE |
| 3,355,376 | 11/1967 | Gorin | 208/10 |
| 3,629,159 | 12/1971 | Gorin | 208/10 |
| 3,657,108 | 4/1972 | Kiovsky | 208/10 |
| 3,725,239 | 4/1973 | Kiovsky | 208/10 |
| 3,764,515 | 10/1973 | Kiovsky | 208/10 |
| 3,824,178 | 7/1974 | Wald | 208/10 |
| 3,983,027 | 9/1976 | McCollum | 208/8 LE |
| 4,123,347 | 10/1978 | Maa | 208/10 |
| 4,162,963 | 7/1979 | Gorin | 208/10 |
| 4,180,452 | 12/1979 | Sinor | 208/8 LE |

OTHER PUBLICATIONS

Derencsenyi et al., *Lawrence Berkeley Laboratory Report*, LBL-4434, (1975), pp. 1-74.

Zielke et al., *Preprints, Div. of Fuel Chem.*, Am. Chem. Soc., 19(2), pp. 306-321.

Shinn et al., "Coal Liquefaction in Inorganic-Organic Liquid Mixture", Paper Presented at A. I. Ch. E. Meeting, Miami, Nov. 1978.

Holten et al., "Hydrogenolysis of a Sub-Bituminous Coal with Molten Zinc Chloride Solutions", Lawrence Berkeley Laboratory, University of California-Berkeley, Dec. 1977, Catalogued as M.S. Thesis, U. Cal. Lib., 3/6/78.

Office of Coal Research, Project Gasoline-Interim Report, 8/63-6/68, vol. II, Book I, pp. 56, 66, 140-142, 159, 166.

*Primary Examiner*—Brian E. Hearn

*Attorney, Agent, or Firm*—Harold M. Dixon; Roger S. Gaither; James E. Denny

[57] ABSTRACT

Improved process for liquefaction of coal by contacting pulverized coal in an inorganic-organic medium solvent system containing a $ZnCl_2$ catalyst, a polar solvent with the structure RX where X is one of the elements O, N, S or P, and R is hydrogen or a lower hydrocarbon radical; the solvent system can contain a hydrogen donor solvent (and must when RX is water) which is immiscible in the $ZnCl_2$ and is a hydroaromatic hydrocarbon, selected from tetralin, dihydrophenanthrene, dihydroanthracene or a hydrogenated coal derived hydroaromatic hydrocarbon distillate fraction.

14 Claims, 1 Drawing Figure

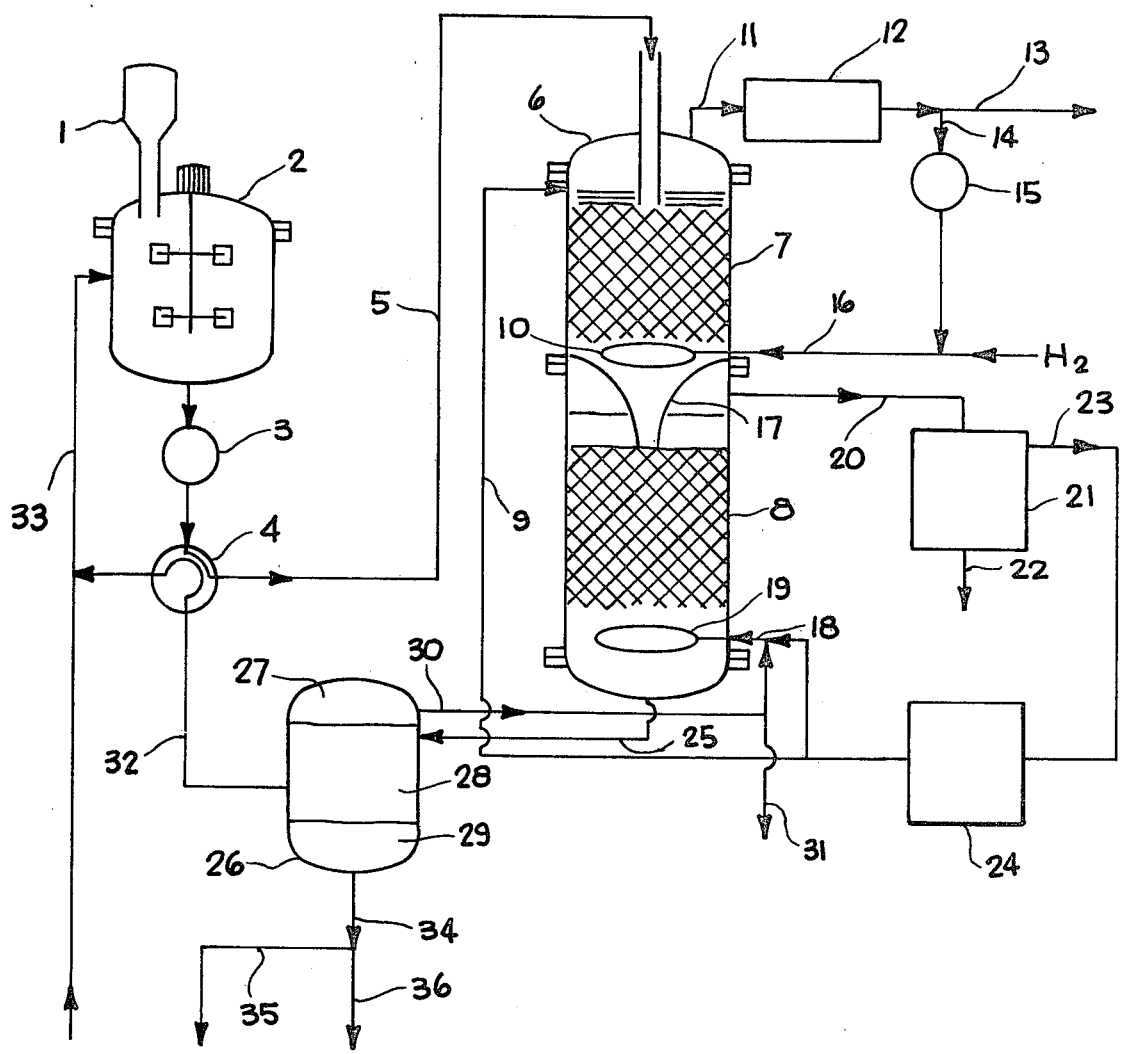
1
2
3
4
5
6
7
8
9
10
11
12
13
14
15
16
$H_2$
17
18
19
20
21
22
23
24
25
26
27
28
29
30
31
32
33
34
35
36

COAL LIQUEFACTION IN AN INORGANIC-ORGANIC MEDIUM

BACKGROUND OF THE INVENTION

The invention described herein was made in the course of or under U.S. Department of Energy Contract No. W-7405-ENG-48 with the University of California.

This invention relates to improvements in the liquefaction of coal. More particularly, this invention relates to an improved process for the conversion of coal at mild conditions with high yields of liquid or soluble products. Still more particularly, the present invention is directed at a process for converting coal at a combination of conditions which includes mild reaction temperatures (i.e., below the temperature at which significant coal pyrolysis occurs) and pressures, and a mixed inorganic-organic catalyst and solvent system.

Considerable work has been done in the past with various processes for the liquefaction of coal. These date back to well before the 1940's when Germany developed and used coal liquefaction to supply its critical needs for petroleum type products during a time when that country experienced shortages. The objectives of coal liquefaction are to produce materials ranging from a synthetic crude oil (syncrude) to gasoline-type hydrocarbons to replace the world's rapidly diminishing petroleum resources. Such liquids are desired in high yields with minimal gaseous product. The syncrude produced can be processed in a conventional petroleum refinery to produce essentially the same spectrum of products as can be derived from petroleum crudes. The refined products from syncrude can be distributed through the existing network. Furthermore, they can be used, in most cases, without the need for modifications in the tens of thousands of present applications of these products.

Although coal conversion processes of recent vintage employ milder conditions than those used in the 1940's (i.e., approximately 500° C. and up to 10,000 psi), they still operate above the pyrolysis temperature of the coal. They do not produce high conversions and yields of liquid product (including soluble product) at the mild conditions of the present invention. At the more severe conditions of these prior art processes, a disproportionate fraction of the coal is converted to light hydrocarbon gases (e.g., methane, ethane, propane) with a large consumption of hydrogen. The supply of hydrogen is a major expense, so processes that reduce the hydrogen consumption are highly desirable.

The most closely related prior art work is that of Consol (i.e., Consolidated Coal Co., now Continental Oil Co.). Consol's early work was at relatively high temperatures (i.e., about 350° C. to 600° C.) and pressure (i.e., about 1000 to 4200 p.s.i), with zinc chloride as a catalyst and reaction medium. In their work with zinc chloride treatment of coal, they did not find that the addition of tetralin had any significant effect on the process generally and on conversion in particular. However, the reaction conditions, when tetralin was used, were relatively severe. Specifically those conditions were about 343° C. with a final pressure of about 2700 p.s.i.g. It is therefore somewhat surprising that we have found that tetralin is a very effective donor solvent under the proper combination of ingredients and conditions —relatively mild conditions with temperatures below coal pyrolysis temperatures.

SUMMARY OF THE INVENTION

In accordance with the present invention, coal liquefaction is achieved by contacting pulverized coal with an inorganic-organic liquid mixture comprising a $ZnCl_2$ catalyst in the presence of a solvent system, at least one member of which is a polar solvent that dissolves in the zinc chloride phase and reduces the melting point of that phase so that it is liquid at process temperature. This polar solvent is selected from the group of compounds with the formula RX in which R is H or a primary or secondary hydrocarbon radical of about 1 to 3 carbon atoms and X is a polar group containing O, N, S, or P, (e.g., OH). The solvent system also can include, and must include if the polar solvent is water (HOH), a hydrogendonor solvent immiscible in the $ZnCl_2$ phase and comprising hydroaromatic hydrocarbon species. The treatment is conducted at a temperature in the range of about 225° C. to about 315° C., in the presence of a gas or vapor phase that can include hydrogen or carbon monoxide or both.

It is among the objects of the present invention to provide a process for the hydroconversion of coal at temperatures below the pyrolysis temperature of the coal.

It is another object of the invention to achieve high conversions of coal to high yields of liquid.

It is still another object of the invention to obtain high conversions of coal to liquids while producing minimal gaseous product.

It is yet another object of the invention to be effective in conversion of subbituminous coals to liquids with high conversions of the coal.

Other objects and advantages will become apparent from the discussion which follows.

BRIEF DESCRIPTION OF THE DRAWING

The FIGURE is a schematic flow diagram of a conversion process with the reactor and principal associated process equipment, such as a blender or mixer for the coal and solvents, separation equipment for solvent, coal, $ZnCl_2$ and gases shown.

DESCRIPTION OF THE PREFERRED EMBODIMENT

The conversion process herein described is carried out at a temperature in the range of about 225° C. to about 315° C. Generally, a temperature in the range of about 250° C. to 300° C. will be found advantageous and preferred, but in some cases a temperature outside that range may be preferred. This treatment temperature is selected to be below the temperature at which significant coal pyrolysis occurs. In this way, pyrolysis reactions that produce light hydrocarbon gases and consume excessive hydrogen are avoided. It is an accomplishment of this invention that a process is provided wherein satisfactory conversion of coal can be obtained without the pyrolysis reactions and less char formation than in prior art processes, and thus at milder conditions than in those processes.

The treatment pressure, that is, the pressure which obtains when the process streams are at treatment temperature as contrasted to the pressure of gas supplied, is at least about 200 p.s.i.g. There is no theoretical limitation on this pressure; however, at substantially higher pressures equipment and processing problems can be experienced. For economic reasons, a pressure of about 200 to below about 1000 p.s.i.g will be preferred, and pressures in the range of about 400 to 800 p.s.i.g will generally be found advantageous and more preferred in most cases.

The $ZnCl_2$ is employed at relatively high ratios to the coal to be converted. Generally, ratios of about 2/1 by weight and higher of $ZnCl_2$ to coal are used to adequately "wet" or contact the coal. There is no known upper limit on the ratio of $ZnCl_2$ to coal, other than practical processing and economic considerations. Above a ratio of about 6/1 there may be unnecessary dilution of reactants, products, and an unnecessary volume of materials to be processed requiring larger equipment. Typically, a ratio in the range of about 2/1 to 4/1 will be found advantageous and preferred commercially.

In this invention a solvent must be present that will dissolve the $ZnCl_2$, or form a liquid $ZnCl_2$ phase at process temperature that may be called a "melt" of the $ZnCl_2$. The reason for this is to liquefy $ZnCl_2$ below its normal melting point, which is about 315° C. Unless the $ZnCl_2$ phase is liquid, it cannot "wet" or contact the coal properly to promote conversion. Preferably, the solvent will produce a $ZnCl_2$ melt at a sufficiently lower temperature (e.g., 200° C.) so that the coal and $ZnCl_2$ melt can be thoroughly, and essentially uniformly, premixed before charging to the reactor or otherwise before being brought up to process temperature.

With the foregoing melt characteristics in mind, the solvent system and amounts of solvent(s) is(are) selected. The solvent serving to liquefy the $ZnCl_2$ (the polar solvent) is selected from compounds with the formula RX in which R is H or a primary or secondary hydrocarbon radical of about 1 to 3 carbon atoms and X is polar group containing O, N, S, or P. Water (HOH) and methanol ($CH_3OH$) are examples of solvents of this type. When the polar solvent selected is water, or other chemically inactive species under treatment conditions, then a hydrogendonor solvent, immiscible with the $ZnCl_2$ phase, is also required. Suitable hydrogen-donor solvents include tetralin, dihydrophenanthrene, dihydroanthracene, and recycled hydrogenated coal-derived hydroaromatic distillate fractions characterized as having about 10 to 24 carbon atoms, boiling in the range of about 200° C. (or 390° F.) to 400° C. (or 750° F.), having a hydrogen to carbon ratio of about 1.1/1 to 1.6/1. As previously mentioned, the hydrogen donor solvents are hydroaromatic hydrocarbons of which tetralin, dihydrophenanthrene, dihydroanthracene are illustrative structures and the recycled hydrogenated coal-derived hydroaromatic distillate fractions can contain one or more of those illustrative structures, as well as other hydroaromatic hydrocarbons with the characteristics set forth above.

The amount of each solvent used varies considerably. Water can be used in as little as about 2% (by weight based on $ZnCl_2$) to obtain a satisfactory melt temperature; however, up to about 12% by weight of water can be employed without significant adverse effects. Preferably, about 5% to 10% water is employed. The hydrogen-donor solvent is employed in a range from 50% to 500% (by weight based on coal). Generally, the hydrogen-donor solvent is employed in an amount of about 75% to 200% by weight based on coal.

Methanol is a preferred member of the group of polar solvents, because it need not be used in combination with either water or a hydrogen-donor solvent, but it can also be used satisfactorily in combination with hydrogen-donor solvents. Other low-molecular-weight alcohols are similarly effective when used alone; however, this is not to be construed as indicating all the solvents are direct equivalents as they are not. The effectiveness of methanol as a solvent is evidenced by the results which obtain from its use. Essentially, as much liquid (i.e., soluble) product is obtained with its use alone as with use of a mixture of $H_2O$ and one of the hydrogen-donor solvents, such as tetralin. Methanol used alone is employed in a range of about 5% to 25% (by weight based on $ZnCl_2$). Preferably about 10 to 20% of methanol is used. Illustrative examples of other alcohols which can be satisfactorily used in the invention are ethanol, propanol and isopropanol. The latter alcohols are used in about 10% to 40% and preferably about 15% to 25% (by weight based on $ZnCl_2$).

Other promoters can be added to the $ZnCl_2$ phase to increase catalytic activity. These additives are employed in a small but effective amount, less than 10% based on $ZnCl_2$. Examples are stannous chloride, zinc oxide, zinc metal, and iodine.

In order to disclose more clearly the nature of the present invention and the advantages thereof, reference will hereinafter be made to certain specific embodiments which illustrate the herein-described process. It should be clearly understood, however, that this is done solely by way of example and is not to be construed as a limitation upon the spirit and scope of the appended claims.

EXAMPLES 1–6

A series of experiments were carried out using various combinations of ingredients and conditions. The specific ingredients and parameters used in a few of these experiments, together with the results obtained, are set forth in the TABLE hereinbelow.

TABLE

EFFECT OF TREATMENT OF WYODAK COAL IN INORGANIC-ORGANIC MEDIA
50g Coal + 275g $ZnCl_2$ treated for 1 hour

| Example No. | Polar Solvent | H-donor Solvent | Temperature (°C.) | $H_2$ Press (bar) | % Soluble (DAF) Cyclohexane | % Soluble (DAF) + Pyridine* |
|---|---|---|---|---|---|---|
| Control No. 1 | (Untreated coal) | | — | — | 1 | 13 |
| Control No. 2 | $H_2O$ - 25g | None | 250 | 35 | 1 | 28 |
| Control No. 3 | $H_2O$ - 25g | None | 300 | 35 | 6 | 51 |
| 1 | $H_2O$ - 25g | Tetralin - 50g | 250 | 0 | — | 65 |
| 2 | $H_2O$ - 25g | Tetralin - 50g | 250 | 35 | 23 | 73 |
| 3 | $H_2O$ - 25g | Tetralin - 50g | 300 | 35 | 47 | 83 |
| 4 | $H_2O$ - 25g | Dihydro-anthracene - 50g | 250 | 35 | — | 41 |
| 5 | $CH_3OH$ - 25g | None | 250 | 35 | — | 72 |

TABLE-continued

EFFECT OF TREATMENT OF WYODAK COAL IN INORGANIC-ORGANIC MEDIA
50g Coal + 275g $ZnCl_2$ treated for 1 hour

| Example No. | Polar Solvent | H-donor Solvent | Temperature (°C.) | $H_2$ Press (bar) | % Soluble (DAF) Cyclohexane | + Pyridine* |
|---|---|---|---|---|---|---|
| 6 | $C_2H_5OH$ - 25g | None | 250 | 35 | — | 100 |

*Corrected For Solvent Incorporation

Materials

The subbituminous coal used was Wyodak from the Roland seam of a mine in Gillette, Wyo. Its size as received was minus ¾ inch, and it subsequently was crushed, milled, and screened. The minus-28, plus-100 mesh fraction was selected, and stored under nitrogen until just before use. The proximate analysis showed 23.5% moisture, 36.0% volatiles, 29.4% fixed carbon, and 11.0% ash. On a dry ash-free basis, the elemental analysis was 73.0% carbon, 6.0% hydrogen, 1.1% nitrogen, 0.9% sulfur, and 19.0% oxygen. The coal was usually charged to the reactor without predrying.

The zinc chloride was of 95%+reagent-grade purity (the remainder being mostly water). Organic solvents used were reagent-grade. The hydrogen gas was of 99.999% ultra-high purity.

Apparatus

The experiments were performed in a 600-ml top-stirred Parr autoclave fabricated from Hastalloy B, and fitted with a 300-ml-capacity borosilicate glass liner. The autoclave was equipped with a 2000-p.s.i.g. pressure gauge and rupture disc. Controlled heating was provided by a 780-watt quartz-fabric-covered mantle, responding to automatic control actuated by an iron-constantan thermocouple which monitored the temperature inside the autoclave.

Experimental Procedure

Four basic steps were involved in each experiment: (1) introduction of materials into the autoclave; (2) establishment of desired temperature and pressure with stirring; (3) maintenance of reaction conditions for a set time; and (4) cooling and depressurization.

The metal halide melts were prepared outside the autoclave to assure complete dissolution before coal addition and to reduce heat-up time. The melt components (300 g. $ZnCl_2$ and the polar solvent, sometimes with other additives) were weighed into the glass liner, which was then heated to 170° C. under nitrogen. The glass liner was then placed in the preheated autoclave, the feed coal (usually 50 g.) and hydrogen-donor solvents (if used) added, and the autoclave closed. Heating and stirring (450 rpm) were begun immediately. The autoclave was purged with hydrogen to remove air, and at 200° C. enough hydrogen was charged so that the total pressure would be close to the desired value at the run temperature, taking into account the partial pressures of the solvent(s) present.

The final temperature was usually attained within 25 minutes after the autoclave was closed. At this time, the total pressure was adjusted to the desired level by adding hydrogen or by partial venting.

At the end of the run, the heating mantle was immediately removed, and the autoclave was immersed in cold water to reduce the temperature, typically to 175° C. within 2 minutes (where depressurization was begun) and to 125° C. within 5 minutes.

Product Treatment and Analysis

After the reactor was cooled, distilled water was added to the reactor contents, and the resulting mixture was vacuum-filtered in a 6-inch Buchner funnel using filter paper. The solid product, here referred to as melt-treated coal (MTC), was washed successively with 2 liters of cold distilled water and 6 liters more of distilled water warmed to 90° C., which often required 2 to 6 hours. The MTC was then dried to constant weight in a vacuum oven (usually for 12 hours) at 100° C. under 40 torr of nitrogen.

A standard Soxhlet apparatus was used to extract approximately 2 g. of dried MTC successively with 200 ml. of cyclohexane and of toluene (or benzene) for 4 hours each, and of pyridine for 24 hours, all at their normal boiling points. The respective extracts are identified as oil, asphaltene, and preasphaltene. The extraction solvents were removed from liquid extracts in weighed Petri dishes, first in the open and then in the vacuum oven at 100° C. for 16 hours.

The MTC and many of the extracts were analyzed for elemental content, and were further characterized by vapor-pressure osmometry and gel-permeation chromatography for molecular weight, and proton-NMR spectroscopy for aromatic/aliphatic character of the hydrogen present.

EXAMPLE 7

In order to facilitate understanding of the invention even further, an illustrative example of the invention practiced on a continuous basis will be described in reference to the drawing.

Crushed but undried coal is added by coal feeder 1 to a mixer 2 where it is mixed with the $ZnCl_2$ melt in a ratio by weight of about 2/1 ($ZnCl_2$ melt/coal) at about 175° C. and atmospheric pressure. It is then heat exchanged with recycle melt in heat exchanger 4 to a temperature of about 225° C. and fed to the top of the reactor 6 by means of pump 3 through line 5.

The reactor 6 as shown is separated into an upper reaction section 7 and a lower extraction section 8. The melt/coal slurry is mixed with a recycled stream of a donor solvent 9 and contacted in section 7 with hydrogen. The hydrogen is admitted to the bottom of the reactor section through a distributor 10 and rises in countercurrent fashion through the reaction section 7 operated at a temperature of about 300° C. and 35 atmospheres of hydrogen pressure. That part of the hydrogen which does not react with the coal or solvent leaves at the top of the reactor 7 through line 11 along with $H_2S$, $CO_2$, light hydrocarbons, and/or any other gases produced. A hydrogen-rich stream for recycle is prepared by passing the gases through one or more adsorbers or scrubbers 12, and if necessary by bleeding off a "purge" stream through line 13. The resulting hydrogen-rich gas is then passed to compressor 15 through line 14, compressed and sent back to the reactor through line 16 along with makeup hydrogen. The melt/coal/solvent slurry passes through reactor section 7 into extraction section 8 through cone 17.

Additional donor solvent is introduced at the bottom of 8 by line 18 through distributor 19 and rises countercurrent to said slurry in 8 which is maintained at a temperature of about 300° C. and a pressure of about 35 atmospheres. The solvent and extracted product contained therein are withdrawn from the reactor through line 20 at the top of 8 and flow to a separation unit 21 where product and solvent are separated and taken off through lines 22 and 23, respectively. The solvent is hydrogenated, as necessary, in reactor 24 according to procedures known in the art, and returned to the reactor through lines 9 and 18.

The extracted coal residue and melt are withdrawn from the bottom of the reactor 6 (or extraction section 8) by line 25 and are sent to a settler 26. In settler 26 three phases form—an organic phase 27, an inorganic phase 28, and a slurry phase 29. The entrained solvent 27 is removed from the top of settler 26 by line 30 and is either recycled to section 8 of reactor 6 through line 18 or produced as product through line 31. Semipure $ZnCl_2$ melt 28, withdrawn from the middle of the settler 26, passes through the reactor-feed heat exchanger 4 through line 32 and is returned to blender 2 along with makeup melt through line 33. Coal residue, including some $ZnCl_2$, is withdrawn at the bottom of settler 26 through line 34 and the liquid $ZnCl_2$ melt is separated and sent to a melt-cleanup step through line 35 and the solids are passed to a gasifier through line 36. In the figure, many standard items have been omitted in the interest of simplicity, such as pressure reducing valves, pumps, heaters, etc.

While particular embodiments of the invention have been described, it will be understood, of course, that the invention is not limited thereto, since many modification may be made; and it is therefore contemplated to cover by the appended claims any such modifications as fall within the true spirit and scope of the invention.

What is claimed is:

1. An improved process for the liquefaction of coal by contacting pulverized coal in the presence of hydrogen at a temperature in the range of about 225° C. to below 315° C. and a pressure of at least 200 p.s.i.g. with a liquid mixture having an inorganic phase and an organic phase, wherein:
   (1) said inorganic phase consists essentially of $ZnCl_2$ catalyst melt and optionally water, and wherein
   (2) said organic phase comprises at least one organic solvent selected from the group consisting of (a) and (b) wherein
      (a) is an organic solvent miscible with $ZnCl_2$ catalyst characterized as being soluble in the organic phase and as reducing the melting point of $ZnCl_2$ catalyst, said organic solvent being selected from the group consisting of methanol, ethanol, propanol, isopropanol, and a mixture thereof, and
      (b) is a hydrogen-donor solvent comprising hydroaromatic hydrocarbons immiscible with the $ZnCl_2$ catalyst, with the provision that the inorganic phase must contain water when a member of (2a) is not selected as a constituent of the organic phase.

2. Process for conversion of coal according to claim 1 wherein the solvent system comprises $H_2O$ and a recycled, coal-derived hydroaromatic distillate characterized as having about 10 to 24 carbon atoms, boiling in the range of about 200° C. to 400° C. and having a hydrogen to carbon (atom) ratio of 1.1/1 to 1.6/1.

3. Process for conversion of coal according to claim 2 wherein the amount of recycled, coal-derived hydroaromatic distillate employed is in the range of about 50% to 500% by weight of coal.

4. Process for conversion of coal according to claim 2 wherein the amount of recycled, coal-derived hydroaromatic distillate employed is in the range of about 75% to 200% by weight of $ZnCl_2$.

5. Process for conversion of coal according to claim 1 wherein the temperature is in the range of about 250° C. to 300° C.

6. Process for conversion of coal according to claim 1 wherein $ZnCl_2$ is employed in a ratio of about 2/1 to 6/1 based on the weight of coal.

7. Process for conversion of coal according to claim 1 wherein $ZnCl_2$ is employed in a ratio of about 2/1 to 4/1 based on the weight of coal.

8. Process for conversion of coal according to claim 1 wherein the treatment pressure employed is in the range of about 200 to 1000 p.s.i.g.

9. Process of conversion of coal according to claim 1 wherein the amount of organic solvent used is in the range of about 2% to 25% based on the weight of $ZnCl_2$.

10. Process of conversion of coal according to claim 1 wherein the amount of organic solvent used is in the range of about 5% to 10% based on the weight of $ZnCl_2$.

11. An improved process for the liquefaction of coal by contacting pulverized coal in the presence of hydrogen at a temperature in the range of about 225° C. to below 315° C. and a pressure of at least 200 p.s.i.g. with a liquid mixture having an inorganic phase and an organic phase, wherein:
   (1) said inorganic phase consists essentially of $ZnCl_2$ catalyst melt and optionally water, and wherein
   (2) said organic phase comprises methanol.

12. Process for conversion of coal according to claim 11 wherein the amount of methanol employed is in the range of about 5% to 25% by weight based on the $ZnCl_2$.

13. Process for conversion of coal according to claim 11 wherein the amount of methanol employed is in the range of about 10% to 20% by weight based on the $ZnCl_2$.

14. Process for the conversion of coal according to claim 11 wherein the solvent system comprises methanol and a recycled, coal-derived hydroaromatic distillate characterized as having about 10 to 24 carbon atoms, boiling in the range of about 200° C. to 400° C., having a hydrogen to carbon ratio of 1.1/1 to 1.6/1.

* * * * *